US005275003A

United States Patent [19]

Agrawal et al.

[11] Patent Number: 5,275,003

[45] Date of Patent: Jan. 4, 1994

[54] HYBRID AIR AND NITROGEN RECYCLE LIQUEFIER

[75] Inventors: Rakesh Agrawal, Emmaus; Donald W. Woodward, New Tripoli; Jianguo Xu, Fogelsville, all of Pa.

[73] Assignee: Air Products and Chemicals, Inc., Allentown, Pa.

[21] Appl. No.: 916,566

[22] Filed: Jul. 20, 1992

[51] Int. Cl.[5] ..... F25J 3/02

[52] U.S. Cl. ..... 62/24; 62/39

[58] Field of Search ..... 62/24, 39

[56] References Cited

U.S. PATENT DOCUMENTS 3,605,422 9/1971 Pryor et al. ..... 62/13
4,152,130 3/1979 Theobald ..... 62/18
4,705,548 11/1987 Agrawal ..... 62/18
4,894,076 1/1990 Dobracki et al. ..... 62/9
5,006,137 4/1991 Agrawal et al. ..... 62/24
5,006,139 4/1991 Agrawal et al. ..... 62/24

*Primary Examiner*—Ronald C. Capossela
*Attorney, Agent, or Firm*—Robert J. Wolff; James C. Simmons; William F. Marsh

[57] ABSTRACT

The present invention relates to a process producing large quantities of liquid product via the cryogenic distillation of air wherein at least a portion of the refrigeration needs of the process is provided by expansion of the feed air. In particular, the present invention is an improved method to meet the liquid nitrogen requirements of the process and comprises elevating the discharge pressure of the nitrogen recycle compressor.

14 Claims, 2 Drawing Sheets

HYBRID AIR AND NITROGEN RECYCLE LIQUEFIER

FIELD OF THE INVENTION

The present invention is directed to a process producing large quantities of liquid product via the cryogenic distillation of air.

BACKGROUND OF THE INVENTION

Liquefied atmospheric gases, including nitrogen, oxygen and argon, are finding increasing uses in industry. Such liquefied atmospheric gases provide cryogenic capabilities for various industrial processes, are more economical to transport in merchant supply and provide ready and economical sources of gaseous product from liquid storage facilities. For instance, liquid nitrogen is increasingly used to freeze food products, to cryogenically embrittle used materials for cleaning or recycle, and as a supply of gaseous nitrogen inerting medium for various industrial processes.

The conventional process for making large quantities of liquid nitrogen and/or liquid oxygen from an air feed is to include an expander scheme with the conventional multiple column distillation system. The expander scheme provides at least a portion of the large amount of refrigeration that is required to remove a large percentage of the air feed as liquid product vis-a-vis a small percentage of the air feed or no percentage of the air feed as liquid product. (As used herein, a "large percentage" of the air feed is defined as at least 15% of the air feed). This inclusion of an expander scheme with the conventional multiple column distillation system is generally referred to in the industry as a liquefier and that is how the term liquefier is used herein.

The most common liquefier probably falls into the category of nitrogen recycle liquefiers. In a nitrogen recycle liquefier, the expander scheme is integrated with the recycling of low pressure column nitrogen overhead such as taught in U.S. Pat. Nos. 3,605,422 and 4,894,076. The nitrogen recycle liquefiers, no matter how many expanders there are, do not try to use the feed air for generating refrigeration before it is fed into the distillation column systems.

U.S. Pat. No. 4,152,130 introduces the concept of air recycling. In the air recycle liquefiers, a major fraction of the air streams entering cold box are compressed to pressures higher than that needed for the distillation system. At least a portion of the high pressure air is isentropically expanded to provide the refrigeration needed for liquefaction while another portion is cooled to a temperature below its critical temperature, so that liquid air can be obtained upon expansion of this cold air stream. This cooled and expanded liquid containing air is then fed into the distillation system for separation. A portion of the isentropically expanded, mainly vapor bearing air can also be fed into the distillation system to supplement the vapor feed necessary for the distillation system. Since all the air, including that fed to the distillation system, enters the cold box at pressures significantly higher than that required by the distillation system, the feed air is used for refrigeration generation or condensation before it enters the distillation system. As compared to the nitrogen recycle liquefiers, this reduces the recirculation flow needed for generating the desired refrigeration which translates into (1) less power loss due to pressure drop, (2) less energy degradation due to heat transfer of the recycle streams and (3) less heat exchanger area. A problem with the air recycle liquefier however, is that as the liquid demand (as a percentage of feed air) increases, the fraction of liquid air in the total feed air increases. This will have an adverse effect on the distillation operation since a large fraction of liquid air in the feed air means a reduced vapor flow to the distillation system, so that not enough vapor is rising in the higher pressure column to generate the boilup for the lower pressure column and to generate the liquid nitrogen which is demanded as reflux and as product. This problem can be overcome by vaporizing a portion or all of the liquid air (or some other liquid process stream) via heat exchange against a condensing stream of high pressure nitrogen as taught in U.S. Pat. No. 4,705,548. This, however, introduces an extra step, namely condensation of nitrogen and vaporization of the liquid air. Since pressure drops as well as energy degradation are involved in this condensation/vaporization step, it means extra power consumption as well as an extra heat exchanger for the condensation/vaporization.

It is an object of the present invention to improve the energy efficiency of the conventional air recycle liquefier by overcoming the above described problem.

SUMMARY OF THE INVENTION

The present invention is an improvement to a process producing large quantities of liquid product via the cryogenic distillation if air. In the process to which the improvement pertains, an air feed is compressed, expanded to generate refrigeration and subsequently fed to a distillation column system. The present invention is an improved method to meet the nitrogen reflux and/or liquid nitrogen product requirements of the process and comprises:

(a) compressing at least a portion of the nitrogen overhead from the distillation column system to a pressure greater than 200 psia, and more preferably to a pressure greater than nitrogen's critical pressure of 492.9 psia;

(b) cooling the nitrogen from step (a) by indirect heat exchange against process vapor streams; and (c) expanding the nitrogen from step (b) wherein said expansion is performed directly after step (b).

DETAILED DESCRIPTION OF THE INVENTION

Figure 1:
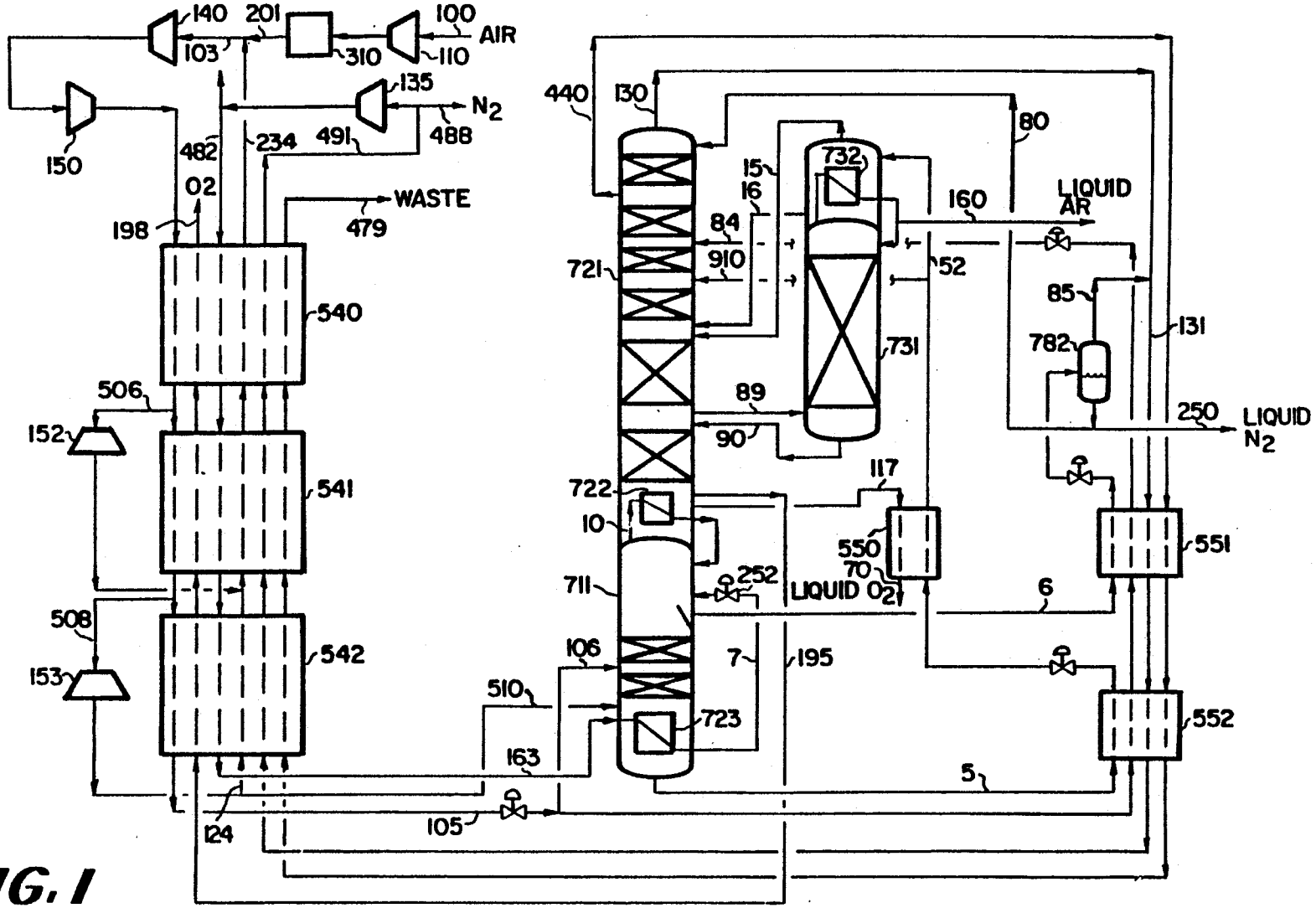
FIG. 1 is a schematic diagram of a conventional process producing large quantities of liquid product via the cryogenic distillation of air.

To better understand the present invention, it is important to understand the evolution of the air recycle liquefier. The air recycle liquefier was developed partly in response to the problems of the nitrogen recycle liquefier relating to the large nitrogen recirculation flow that the nitrogen recycle liquefier requires for generating the desired refrigeration. In the air recycle liquefiers, a major fraction of the air streams entering cold box are compressed to pressures higher than that needed for the distillation system. At least a portion of the high pressure air is isentropically expanded to provide the refrigeration needed for liquefaction while another portion is cooled to a temperature below its critical temperature, so that liquid air can be obtained upon expansion of this cold air stream. This cooled and expanded liquid containing air is then fed into the distillation system for separation. A portion of the isentropically expanded, mainly vapor bearing air can also be fed into the distillation system to supplement the vapor feed necessary for the distillation system. Since all the air, including that fed to the distillation system, enters the cold box at pressures significantly higher than that required by the distillation system, the feed air is used for refrigeration generation or condensation before it enters the distillation system. As compared to the nitrogen recycle liquefiers, this reduces the recirculation flow needed for generating the desired refrigeration which translates into (1) less power loss due to pressure drop, (2) less energy degradation due to heat transfer of the recycle streams and (3) less heat exchanger area. A problem with the air recycle liquefier however, is that as the liquid demand (as a percentage of feed air) increases, the fraction of liquid air in the total feed air increases. This will have an adverse effect on the distillation operation since a large fraction of liquid air in the feed air means a reduced vapor flow to the distillation system, so that not enough vapor is rising in the higher pressure column to generate the boilup for the lower pressure column and to generate the liquid nitrogen which is demanded as reflux and as product. This problem can be overcome by vaporizing a portion or all of the liquid air (or some other liquid process stream) via heat exchange against a condensing stream of high pressure nitrogen as taught in U.S. Pat. No. 4,705,548. This, however, introduces an extra step, namely condensation of nitrogen and vaporization of the liquid air. Since pressure drops as well as energy degradation are involved in this condensation/vaporization step, it means extra power consumption as well as an extra heat exchanger for the condensation/vaporization.

The present invention is an improved method of meeting the liquid nitrogen demands which overcomes the above described problem while retaining the advantages of the air recycle liquefier. The steps of the present invention comprise:

(a) compressing at least a portion of the nitrogen overhead from the distillation column to a pressure greater than 200 psia, and more preferably to a pressure greater than nitrogen's critical pressure of 492.9 psia;

(b) cooling the nitrogen from step (a) by indirect heat exchange against process vapor streams; and (c) expanding the nitrogen from step (b) across a valve or in an expander wherein said expansion is performed directly after step (b).

The skilled practitioner will appreciate that the temperature to which the nitrogen must be cooled in step (b) (hereinafter the "cooling temperature") is a function of (1) the pressure to which the nitrogen is compressed in step (a), (2) whether the expansion in step (c) is performed across a valve or in an expander (i.e. the isentropic efficiency of the expansion), (3) the pressure to which the nitrogen is expanded in step (c) and (4) the desired fraction of the nitrogen which is to be liquid at the end of step (c). These functionalities are provided on any standard Mollier chart for nitrogen. The key to the present invention is that the elevated pressure in step (a) makes it possible to remove significantly more enthalpy from the nitrogen stream at the cooling temperatures which can be obtained for the nitrogen stream in the front end/main heat exchanger . . . so much more enthalpy that the enthalpy removing condensation step against a vaporizing process liquid stream is no longer required. In effect, the refrigeration that was formerly indirectly provided to the nitrogen in the conventional air recycle liquefier (i.e. by using the refrigeration to first liquefy a portion of the feed air and then using this portion of the feed air to liquefy the nitrogen) is now directly provided to the nitrogen in the main heat exchanger without an intervening liquid vaporization step. The increased nitrogen compression requirement which makes this possible is more than offset by a reduced air recycle flow through the air compressors since either less or no air is now required to be liquefied. The present invention essentially provides the advantages of both the air recycle liquefier (with respect to reducing the recirculation flow) and the nitrogen recycle liquefier (with respect to producing some liquid nitrogen directly).

Regarding the situation where the expansion of the nitrogen in step (c) of the present invention is performed in a nitrogen expander as opposed to being performed across a valve, the skilled practitioner will appreciate that a dense fluid expander is appropriate in this situation since the feed to the expander is a dense fluid and/or the expander effluent will have a liquid component. In this situation, the vapor component of the dense fluid expander effluent can be warmed by indirect heat exchange against process streams in order to provide additional refrigeration to the process.

The present invention is best illustrated by applying it to a conventional air recycle liquefier. FIG. 1 is representative of a conventional liquefier to which the present invention pertains. FIG. 1 is based on the teachings of U.S. Pat. No. 4,705,548. Referring now to FIG. 1, an ambient air feed in stream 100 is compressed in compressor 110 and cleaned of impurities which will freeze out at cryogenic temperatures in cleaning bed 310. The resultant stream 201 is combined with an air recycle stream 234 to form stream 103 which is further compressed in compressors 140 and 150 prior to being cooled by indirect heat exchange against warming process streams in heat exchanger 540. A portion of stream 103 is removed as stream 506 and expanded in expander 152. The remaining portion of stream 103 is further cooled by indirect heat exchange against warming process streams in heat exchanger 541 after which a second portion of stream 103 is removed as stream 508 and expanded in expander 153. A portion of expander 153's discharge is removed as stream 124 and warmed by indirect heat exchange against cooling process streams in heat exchanger 542 after which stream 124 is combined with expander 152's discharge and further warmed by indirect heat exchange against cooling process streams in heat exchangers 541 and 540 to form the air recycle stream 234. The remaining portion of expander 153's discharge is fed to the bottom of high pressure column 711 as stream 510. The portion of stream 103 remaining after stream 508 is removed is further cooled by indirect heat exchange against warming process streams in heat exchanger 542 to form stream 105. A portion of stream 105 is fed to an intermediate location of high pressure column 711 as stream 106 while the remaining portion is further cooled by indirect heat exchange against warming process streams in heat exchangers 552 and 551 before being fed to an intermediate location of low pressure column 721 as stream 84.

The high pressure column feed streams 106 and 510 are rectified into a high pressure nitrogen overhead in stream 10 and a high pressure crude liquid oxygen bottoms in stream 5. Stream 5 is subcooled by indirect heat exchange against warming process streams in heat exchanger 552, reduced in pressure and subsequently warmed by indirect heat exchange against a liquid oxygen product in heat exchanger 550. A portion of stream 5 is then fed to an intermediate location of low pressure column 721 as stream 910 while the remaining portion is fed to reboiler/condenser 732 at the top of crude argon column 731 as stream 52.

An argon containing gaseous side stream 89 is removed from a lower intermediate location of the low pressure column and also fed to crude argon column 731 in which stream 89 is rectified into an argon-rich vapor overhead and an argon-lean bottoms liquid in stream 90 which is returned to the low pressure column. The argon-rich vapor overhead is condensed in reboiler/condenser 732 against the high pressure crude liquid oxygen bottoms in stream 52. A portion of the condensed argon-rich vapor overhead is removed as a liquid argon product in stream 160 while the remaining portion of the condensed argon-rich vapor overhead is used to provide reflux for the crude argon column. The portion of the high pressure crude liquid oxygen bottoms in stream 52 that is vaporized against the argon-rich vapor overhead is fed to the low pressure column in stream 15 while the portion which is not vaporized is fed to the low pressure column in stream 16.

The low pressure column feed streams 910, 84, 15 and 16 are distilled into a low pressure nitrogen overhead in stream 130 and a low pressure liquid oxygen bottoms. The high pressure column and the low pressure column are thermally linked such that at least a portion of the high pressure nitrogen overhead in stream 10 is condensed in reboiler/condenser 722 against vaporizing low pressure liquid oxygen bottoms. The condensed high pressure nitrogen overhead is used to provide reflux for the high pressure column.

The low pressure nitrogen overhead in stream 130 is combined with a vapor flash stream 85 from flash drum 782 to form stream 131. Stream 131 is warmed by indirect heat exchange against process streams in heat exchangers 551, 552, 542, 541 and 540 to form stream 491. A portion of Stream 491 is removed as a gaseous nitrogen product in stream 488 while the remaining portion is compressed in compressor 135 to approximately 120 psia to form stream 482. Stream 482 is cooled to near its dew point by indirect heat exchange against warming process streams in heat exchangers 540, 541 and 542. The resultant stream 163 is subsequently condensed in reboiler/condenser 723 against vaporizing high pressure crude liquid oxygen bottoms. The resultant stream 7 is expanded across valve 252 and subsequently fed as reflux to the high pressure column. A portion of the low pressure column reflux is removed from the high pressure column in stream 6. Stream 6 is subcooled by indirect heat exchange against warming process streams in heat exchanger 551 and flashed in flash drum 782. A portion of the saturated liquid resulting from this flash is removed as a liquid nitrogen product in stream 250 while the remaining portion is used as reflux for the low pressure column in stream 80. The saturated vapor resulting from this flash in stream 85 is combined with the low pressure nitrogen overhead in stream 130 to form stream 131.

A nitrogen enriched waste stream 440 is withdrawn from a upper intermediate location of the low pressure column, warmed by indirect heat exchange against process streams in heat exchangers 551, 552, 542, 541 and 540 and subsequently removed as a gaseous waste product in stream 479. A portion of the low pressure liquid oxygen bottoms is removed in stream 117 and subcooled in heat exchanger 550 before being removed as a liquid oxygen product in stream 70. A portion of the vaporizing low pressure liquid oxygen bottoms is removed in stream 195 and warmed by indirect heat exchange against cooling process streams in heat exchangers 542, 541 and 540 before being removed as a gaseous oxygen product in stream 198.

Figure 2:
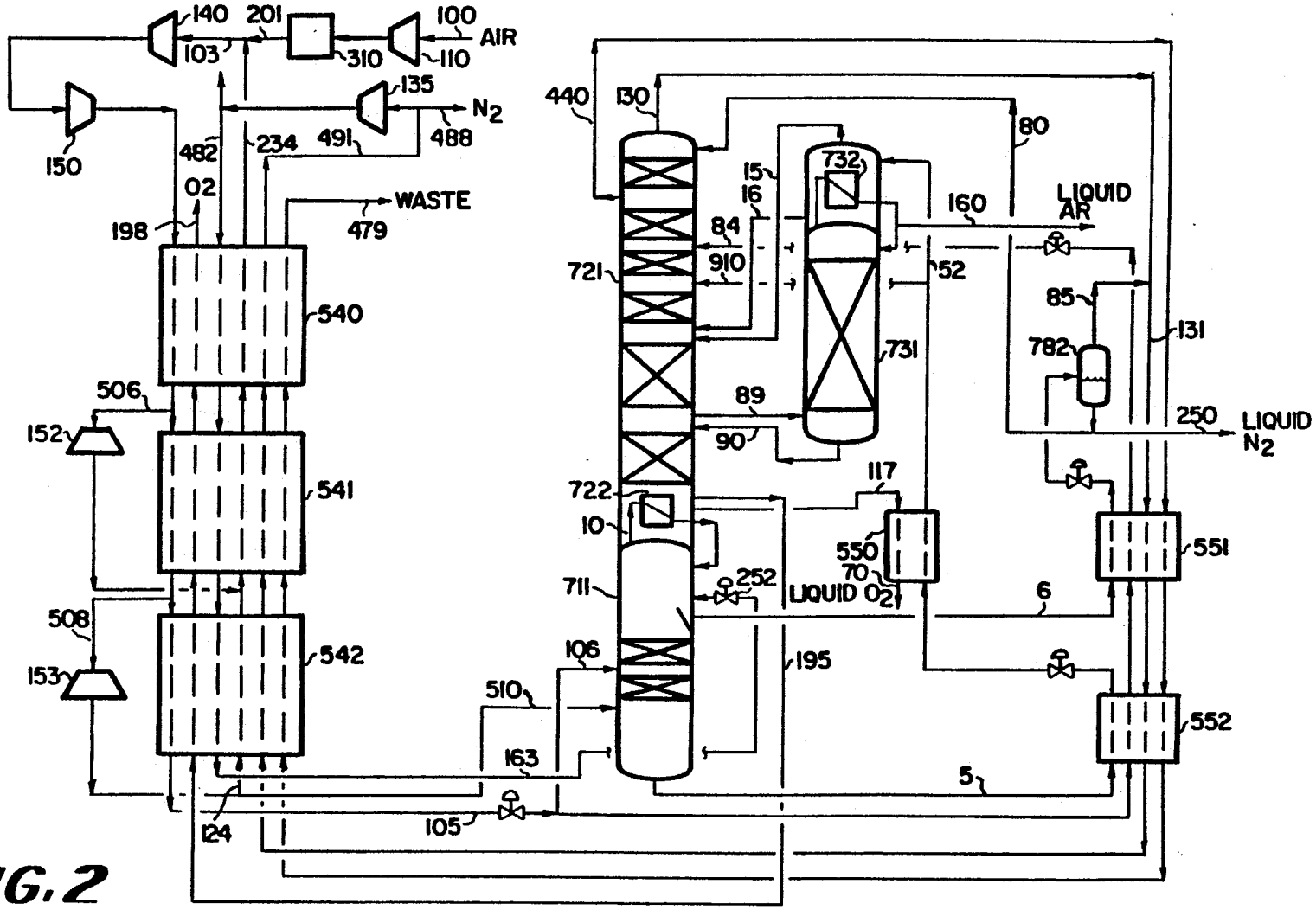
FIG. 2 is a schematic diagram of one embodiment of the process of the present invention.

FIG. 2 is an embodiment of the present invention as applied to the flowsheet depicted in FIG. 1. FIG. 2 is identical to FIG. 1 (similar features of FIG. 2 utilize common numbering with FIG. 1) except that reboiler/condenser 723 has been eliminated. By elevating the discharge pressure of compressor 135, it is possible to remove significantly more enthalpy from stream 482 in the main heat exchanger . . . so much more that the enthalpy removing condensation step in reboiler/condenser 723 is no longer required. In effect, the refrigeration that was formerly indirectly provided to the nitrogen in reboiler/condenser 723 is now directly provided to the nitrogen in the main heat exchanger. Since less air is now required to be liquefied, the flow of air in stream 105 is decreased. Furthermore, due to increased liquefaction efficiency, the air compressor recycle flow in stream 124 can be reduced. Both of these factors more than offset the increased nitrogen compression requirement in compressor 135.

Although not shown in FIG. 2, the shaft work produced from the air expanders can be used to drive one or more of the compressors in the process. Similarly, where the expansion of the nitrogen in step (c) of the present invention is performed in a dense fluid expander as opposed to being performed across a valve, the shaft work from this dense fluid expander can be used to drive one or more compressors in the process.

FIG. 2 produces almost all of the refrigeration for the process from expansion of the feed air. It should be pointed out that a recycle nitrogen stream could be used with at least one additional nitrogen expander (i.e. in addition to the dense fluid expander contemplated in step (c) of the present invention) to supplement the refrigeration. In such a case, the shaft work produced from this refrigeration providing nitrogen expander could also be used to drive one or more compressors in the process.

To further improve the energy efficiency of the process as depicted in FIG. 2, one may increase the operating pressure of the low pressure column from the conventional range of 17–24 psia to an elevated range between 25 and 50 psia. This elevated pressure range increases the energy efficiency of the process by reducing the irreversibility of the conventional liquefier. Irreversibility is commonly called lost work or lost exergy. In the distillation system, exergy loss can be reduced by reducing the driving force for mass transfer. On an x-y equilibrium diagram, the driving force for mass transfer is shown by the distance between the equilibrium curve and the operating lines. At the same liquid to vapor flow ratios in the distillation column, the driving force can be reduced by elevating the column operating pressure to move the equilibrium curve closer to the operating lines. This effect is more noticeable in the low pressure column. Exergy loss can be further reduced in the conventional liquefier by reducing the driving force for heat transfer in the front end heat exchanger(s). On a plot of temperature versus enthalpy change, the driving force for heat transfer is shown by the distance between the line for the cooling stream and the line for the warming stream. Elevating the pressure of the low pressure column in turn allows elevation of the expander scheme discharge pressure. For a typical inlet pressure of 600 psia, elevating the expander scheme discharge pressure can adjust the shape of the cooling curves to allow a smaller average heat transfer driving force with the same size heat exchanger. An elevated pressure in the low pressure column also increases the density of the process gas streams, particularly the low pressure streams. Equipment sizes can be reduced for capital savings due to the lower volumetric gas flows. The upper limit of 50 psia accounts for the fact that, as the pressure is continually elevated, the benefits of reduced irreversibility are eventually offset by the prohibitive number of additional trays that are required in the distillation system. In effect, the elevated pressure range represents an optimum trade off between reducing the irreversibility of the process at the expense of increasing the capital requirements of the process.

It should be noted that where the above described elevated pressure range is utilized and where a large fraction of the product streams are not liquefied and are demanded at significantly lower pressure than that of the low pressure column or vented to the atmosphere, these product streams can be expanded to provide refrigeration. Such an expansion exploits the fact that such product stream will also be at an elevated pressure. Although preferentially they should be isentropically expanded in an expander, if needed for economical reasons, they could be isenthalpically expanded across a valve.

In summary, the present invention is an effective method for increasing the energy efficiency of a conventional air recycle liquefier.

The present invention has been described with reference to a specific embodiment thereof. This embodiment should not be viewed as a limitation to the present invention, the scope of which should be ascertained by the following claims.

We claim:

1. In a process for the cryogenic distillation of an air feed wherein the process generates an amount of refrigeration sufficient to remove at least 15% of the air feed as a liquid nitrogen product stream and/or a liquid oxygen product stream; wherein the air feed is initially compressed; wherein at least a portion of said amount of refrigeration is generated by expanding at least a portion of the compressed air feed; wherein at least a portion of the air feed is fed to a distillation column system having a liquid nitrogen reflux requirement in which the air feed is rectified into a gaseous nitrogen overhead; an improved method to provide at least a portion of the liquid nitrogen reflux requirement and/or at least a portion of the liquid nitrogen product stream comprising:

(a) compressing at least a first portion of the gaseous nitrogen overhead to a pressure greater than 200 psia;

(b) cooling the nitrogen from step (a) by indirect heat exchange against process vapor streams; and (c) expanding the nitrogen from step (b) wherein said expansion is performed directly after step (b) such that there is no intervening condensation step between steps (b) and (c) whereby the nitrogen from step (b) is condensed by indirect heat exchange against a vaporizing process stream.

2. The process of claim 1 wherein the nitrogen in step (a) is compressed to a pressure greater than nitrogen's critical pressure.

3. The process of claim 1 wherein the expansion in step (c) is performed across a valve.

4. The process of claim 1 wherein the expanded nitrogen from step (c) contains a vapor component in addition to containing said portion of the liquid nitrogen reflux requirement and/or said portion of the liquid nitrogen product stream and wherein a second portion of said amount of refrigeration is provided to the process by warming said vapor component by indirect heat exchange against process streams.

5. The process of claim 4 wherein a third portion of said amount of refrigeration is provided to the process by:

(i) compressing a second portion of the gaseous nitrogen overhead;

(ii) cooling the nitrogen from step (i) by indirect heat exchange against process streams; and (iii) expanding the nitrogen from step (ii) in an expander to obtain a gaseous expander effluent; and (iv) warming the gaseous expander effluent from step (iii) by indirect heat exchange against process streams.

6. The process of claim 5 wherein shaft work is generated from said expansion of the compressed feed air and/or from said expansion of the first portion of the gaseous nitrogen overhead and/or from said expansion of the second portion of the gaseous nitrogen overhead and wherein the shaft work is used to provide at least a portion of the compression in the process.

7. The process of claim 1 wherein the distillation column system comprises a high pressure column and a low pressure column; wherein the air feed which is fed to the distillation column system is fed to the high pressure column in which the air feed is rectified into a high pressure nitrogen overhead and a high pressure crude liquid oxygen bottoms; wherein at least a portion of the high pressure crude liquid oxygen bottoms is fed to the low pressure column in which the liquid oxygen bottoms is distilled into the gaseous nitrogen overhead and a low pressure liquid oxygen bottoms; wherein the high pressure column and the low pressure column are thermally linked such that at least a portion of the high pressure nitrogen overhead is condensed in a reboiler/condenser against a vaporizing low pressure column oxygen-rich liquid; and finally wherein at least a portion of the condensed high pressure nitrogen overhead is used as a portion of the liquid nitrogen reflux requirement and/or a portion of the liquid nitrogen product stream.

8. The process of claim 7 wherein the improvement to increase the efficiency of the process further comprises operating the low pressure column at a pressure between 25 and 50 psia.

9. The process of claim 8 wherein the expansion of at least a portion of the compressed air feed comprises:

(a) cooling the compressed air feed by indirect heat exchange against process streams;

(b) splitting the compressed air feed into a first split feed stream and a second split feed stream;

(c) expanding the first split feed stream through a warm expander and recycling the expanded first split feed stream to the air feed while providing refrigeration to the air feed by indirect heat exchange;

(d) further cooling the second split feed stream by indirect heat exchange against process streams;

(e) further splitting the second split feed stream into a third split feed stream and a fourth split feed stream;

(f) expanding the third split feed stream through a cold expander and recycling a portion of the expanded third split feed stream to the air feed while providing refrigeration to the air feed by indirect heat exchange;

(g) further cooling the fourth split feed stream by indirect heat exchange against process streams;

(h) introducing a portion of the fourth split feed stream into the low pressure column for rectification; and finally (i) introducing the remaining portion of the fourth split feed stream and the remaining portion of the expanded third split feed stream into the high pressure column for rectification.

10. The process of claim 9 wherein a portion of the low pressure liquid oxygen bottoms is removed as the liquid oxygen product stream.

11. The process of claim 10 wherein a nitrogen enriched gaseous stream is withdrawn from an upper location of the low pressure column, warmed by indirect heat exchange against process streams and subsequently removed as a nitrogen enriched gaseous product stream.

12. The process of claim 11 wherein a portion of the low pressure liquid oxygen bottoms is warmed by indirect heat exchange against process streams and subsequently removed as a gaseous oxygen product.

13. The process of claim 12 wherein a second portion of said amount of refrigeration is generated by expanding the nitrogen enriched gaseous stream prior to warming said stream by indirect heat exchange against process streams and/or by expanding the gaseous oxygen product prior to warming the gaseous oxygen product by indirect heat exchange against process streams.

14. The process of claim 13 wherein:

(a) the distillation column system further comprises a crude argon column;

(b) an argon containing gaseous side stream is removed from a lower intermediate location of the low pressure column and fed to the crude argon column in which the argon containing gaseous side stream is rectified into an argon-rich vapor overhead and an argon-lean bottoms liquid;

(c) the argon-lean bottoms liquid is returned to the low pressure column;

(d) at least a portion of the argon-rich vapor overhead is condensed in a second reboiler/condenser against vaporizing high pressure crude liquid oxygen bottoms;

(e) a portion of the condensed argon-rich vapor overhead is removed as a liquid argon product; and finally (f) the remaining portion of the condensed argon-rich vapor overhead is used to provide reflux for the crude argon column.

* * * * *